US005864104A

United States Patent [19]

Tawada et al.

[11] Patent Number: 5,864,104

[45] Date of Patent: Jan. 26, 1999

[54] ELEVATOR DOOR CONTROL APPARATUS

[75] Inventors: Masanori Tawada; Yoshikatsu Hayashi, both of Tokyo, Japan

[73] Assignee: Mitsubishi Denki Kabushiki Kaisha, Tokyo, Japan

[21] Appl. No.: 767,072

[22] Filed: Dec. 16, 1996

[30] Foreign Application Priority Data

Jul. 3, 1996 [JP] Japan ..... 8-173854

[51] Int. Cl.[6] ..... B66B 13/14

[52] U.S. Cl. ..... 187/316; 49/28

[58] Field of Search ..... 187/316, 317; 49/28

[56] References Cited

U.S. PATENT DOCUMENTS 5,162,711 1/1992 Heckler ..... 318/264
5,274,312 12/1993 Gerstenkorn ..... 318/617
5,378,861 1/1995 Barten et al. ..... 187/316
5,587,565 12/1996 Schroder-Brunloop et al. ..... 187/316
5,625,175 4/1997 Gutknecht et al. ..... 187/316

FOREIGN PATENT DOCUMENTS 844545 5/1998 European Pat. Off. .

*Primary Examiner*—Robert E. Nappi
*Attorney, Agent, or Firm*—Leydig, Voit & Mayer

[57] ABSTRACT

An elevator door control apparatus according to the present invention includes a driver for driving an elevator door; a torque detector, connected to the driver, for detecting torque command values during driving and the maximum torque command value; a standard door memory; an optimal door speed calculator for calculating an optimal door speed from the standard door values stored in memory and from the torque command values detected by the torque detector; and a door speed command for outputting a speed command signal to the driver, based on the door speed calculated by the optimal door speed calculator.

10 Claims, 6 Drawing Sheets

ELEVATOR DOOR CONTROL APPARATUS

BACKGROUND OF THE INVENTION

1. Field of the Invention

The present invention relates to an elevator door control apparatus, and more particularly, to an elevator door control apparatus for not only increasing safety to users in opening and closing motions of an elevator door, but also making it easy to perform door speed adjustment at installation.

2. Description of the Related Art

FIG. 1 is a block diagram showing internal construction of this type of elevator door control apparatus, and FIGS. 2 to 4 show waveforms of door closing motions. In FIG. 1, reference numeral (hereinafter: numeral) 1 represents an elevator control panel, and numeral 2 an I/O port where a door open command is inputted from the elevator control panel 1. Further, numeral 3 represents a ROM saving operation programs for a CPU 4 and several sorts of predetermined motor speed commands beforehand, and numeral 4 the CPU controlling internal operations of the elevator door control apparatus. Furthermore, numeral 5 represents a pulse width modulation (PWM) unit converting a PWM command inputted by the CPU 4 into a gate signal, numeral 6 a gate signal generator driving a below-mentioned power circuit 7 based on the gate signal from the PWM unit 5, and numeral 7 the power circuit 7 for driving motor 8 represents. Moreover, numeral 8 the motor, numeral 9 a pulse encoder attached to the motor 8, and numeral 10 a pulse count unit counting output pulses from the pulse encoder 9. In addition, numeral 11 represents a RAM saving calculation results of the CPU 4 and various data, numeral 12 a power supply, numeral 13 a display unit providing various displays to a user, and numeral 14 a speed adjustment set pin for switching speed command values that are saved in the ROM 3 and read by the CPU 4.

Next, using FIGS. 1 to 4, known control of door closing motions will be described. When a door close command is generated by the elevator control panel 1, the command is read into the I/O port 2, and, according to this door close command, a motor speed command, as represented by reference waveform (hereinafter: waveform) 1*a* in FIG. 2, is read from the ROM 3 into the CPU 4. Here, by the motor speed command, the pulse count unit 10 counts output pulses from the pulse encoder 9 attached to the motor 8, and the counted value is sent to the CPU 4. Then, the CPU 4 calculates the position of a door from the counted value to read an adequate motor speed command value from the ROM 3 using the positional information. In addition, the motor speed command value read from the ROM 3 can also be switched by the speed adjustment set pin 14.

The CPU 4 obtains a torque command value, as represented by code 3*a* in FIG. 4, that is calculated from the speed difference between the motor speed command value read from the ROM 3 and an actual motor speed which is obtained from the counted value outputted from the pulse count unit 10 and is represented by code 2*a* in FIG. 3, and that is necessary to make the motor follow the motor speed command value. Further, the CPU 4 sends a PWM command corresponding to this torque command to the PWM unit 5, which converts it into a gate signal, and the power circuit 7 is driven by a command outputted from the gate signal generator 6 receiving this gate signal. Furthermore, the power circuit 7 drives the motor 8, so the rotation speed of the motor 8 follows the motor speed command value.

Regarding the above-mentioned door closing motion, door closing energy is regulated by national regulations (ASME 112.4 or BS 2655 Part 1 2.7.2, and the like). The door closing energy can be obtained by door weight and door speed as shown in equation (1).

$$\text{Door Closing Energy}=\{(\text{Door Weight})/(2\times(\text{Gravitational Acceleration}))\}\times(\text{Door Speed})^2 \quad (1)$$

Then, in order to meet the standard values of the national regulations, it is necessary to change the door speed, that is, a motor speed according to the door weight. However, sizes and materials of doors vary since elevator specifications are different in every building. Presently, installers calculate door weight from door specifications and perform speed adjustment at sites.

As a supplementary explanation regarding the door closing energy, the door speed is an average door closing speed, which is also clearly written in the national regulations. Specifically, door speed is obtained from the following equation (2).

$$\text{Average Door Closing Speed}=(\text{Moving Distance from a fully Opened Position to a fully Closed Position})/(\text{Run Time}) \quad (2)$$

In addition, the run time is defined, for example, as the time required for running through the distance that is the result of subtraction of 25 mm from each distance between the fully opened and fully closed positions, in case of a parting-from-center door. For more specific explanation, referring to FIG. 5, if the door speed is the value represented by waveform 4*a* in FIG. 5, the partition t1 in FIG. 5 corresponds to the part being 25 mm distant from the fully opened position, and partition t2 corresponds to the part being 25 mm distant from the fully closed position. Hence, the running time in this case corresponds to the partition T1 between the partitions t1 and t2.

As described above, in the door closing motion, there are regulations on the door closing energy, and the known art has a problem of requiring significant man-power for establishing the of weight of every door at all sites, and for adjustment of door speeds for every door.

In addition, another problem is that, as described above, door weight is calculated by installers, and hence, there are possibilities of calculating an erroneous door weight due to human errors.

Moreover, an additional problem on the contents of speed control is that, as understood from the definition of the average door closing speed, it is not determined as the speed adjustment corresponding to the door closing energy even if closing time is changed by adjusting the speeds only near the fully opened and fully closed positions.

SUMMARY OF THE INVENTION

The present invention is intended to solve these problems, and its purpose is to obtain an elevator door control apparatus making it easy and optimal to change the door speed so as to correspond to the door closing energy.

An elevator door control apparatus according to the present invention comprises: driving means for driving an elevator door; torque detecting means, connected to the driving means, for detecting torque command values at the time of driving; reference data saving means for saving reference data; first optimal door speed calculating means for calculating an optimal door speed from the reference data saved in the reference data saving means and the torque command values detected by the torque detecting means; and door speed commanding means for outputting a speed command signal to the driving means, based on a door speed calculated by the first optimal door speed calculating means, whereby the elevator door control apparatus performs speed adjustment at the time of installation of an elevator door.

In addition, the reference data saving means saves the data regarding speed and torque when an elevator door having standard weight is driven.

Further, the torque detecting means comprises: a torque command value detector for detecting torque command values at the time of driving; and a maximum torque command value detector for detecting a maximum value among torque command values. Then, the first optimal door speed calculating means calculates the optimal door speed, based on the reference data and the maximum value among the torque command values.

Furthermore, the torque detecting means comprises: a torque command value detector for detecting torque command values at the time of driving; and a torque command accumulated value calculator for calculating a torque command accumulated value from the torque command values. Then, the first optimal door speed calculating means calculates the optimal door speed based on the reference data and the torque command accumulated value.

Moreover, in case the speed adjustment of an elevator door is performed at the time of installation of the elevator door, the door speed commanding means should output to the driving means a speed command signal different from that in a usual motion. Hence, the elevator door control apparatus further comprises door speed inspection instructing means for outputting a door speed inspection instruction signal to the door speed commanding means.

In addition, an elevator door control apparatus according to the present invention comprises: driving means for driving an elevator door; door closed position detecting means for measuring a moving distance of the door at the time of opening and closing; time detecting means for measuring time required for opening and closing; reference data saving means for saving reference data; second optimal door speed calculating means for calculating the optimal door speed from the reference data saved in the reference data saving means, the moving distance, and the time required for opening and closing; and door speed commanding means for outputting a speed command signal to the driving means, based on the door speed calculated by the second optimal door speed calculating means, whereby the elevator door control apparatus performs the speed adjustment at the time of installation of an elevator door.

The elevator door control apparatus of the present invention comprises: driving means for driving an elevator door; torque detecting means, connected to the driving means, for detecting torque command values at the time of driving; reference data saving means for saving reference data; first optimal door speed calculating means for calculating an optimal door speed from the reference data saved in the reference data saving means and the torque command values detected by the torque detecting means; and door speed commanding means for outputting a speed command signal to the driving means, based on the door speed calculated by the first optimal door speed calculating means, whereby the elevator door control apparatus performs the speed adjustment at the time of installation of an elevator door. Therefore, door weight is recognized with torque command values, and, by modifying door closing time based on the recognition result, an average door closing speed is adjusted. Therefore, it becomes easy for door closing energy to meet the standard value. Consequently, it becomes unnecessary to conventionally perform calculation of door weight and individual adjustment at sites for meeting the door closing energy standard. Therefore, advantages of the present invention are not only reduction of installation and adjustment time, but also securing of elevator user's convenience.

In addition, the reference data saving means saves the data regarding speed and torque when an elevator door having standard weight is driven. Hence, by comparing the torque to the data at the standard door weight, it can be easily recognized whether the elevator door is heavier or lighter than the standard door. Further, since the speed adjustment of the elevator door is performed based on the recognized weight, the optimal door speed can be easily obtained and adjustment to the optimal door speed can be easily performed.

Further, the torque detecting means comprises: a torque command value detector for detecting torque command values at the time of driving; and a maximum torque command value detector for detecting the maximum value among torque command values. Then, the first optimal door speed calculating means calculates the optimal door speed based on the reference data and the maximum torque command value. Therefore, since the weight of the elevator door is recognized by comparing the reference data and the maximum value, the optimal speed can be obtained with a simply configured circuit.

Furthermore, the torque detecting means comprises: a torque command value detector for detecting torque command values at the time of driving; and a torque command accumulated value calculator for calculating a torque command accumulated value from the torque command values. Then, the first optimal door speed calculating means calculates the optimal door speed based on the reference data and the torque command accumulated value. In addition, since the door weight is determined by the accumulation result of torque command values, it becomes possible to avoid erroneous recognition of the door weight due to instantaneous change of a torque command which is derived from dust plugging and the like. Therefore, it becomes possible to obtain the door weight in the high and stable precision. Furthermore, adjustment to the optimal speed can be performed and elevator user's convenience can be secured easily and certainly.

More over, in case the speed adjustment of an elevator door is performed at the time of-installation of the elevator door, in order that the door speed commanding means may output to the driving means a speed command signal different from that in a usual motion, the elevator door control apparatus further comprises door speed inspection instructing means for outputting a door speed inspection instruction signal to the door speed commanding means. Hence, it is sufficient to consider the case of a single speed command value without surveying relations between torque command values and respective door weights to various speed command values. Therefore, adjustment to the optimal speed can be easily performed.

In addition, an elevator door control apparatus according to the present invention comprises: driving means for driving an elevator door; door closed position detecting means for measuring a moving distance of the door at the time of opening and closing; time detecting means for measuring time required for opening and closing; reference data saving means for saving reference data; second optimal door speed calculating means for calculating the optimal door speed from the reference data saved in the reference data saving means, the moving distance, and the time required for opening and closing; and door speed commanding means for outputting a speed command signal to the driving means, based on the door speed calculated by said second optimal door speed calculating means, whereby the elevator door control apparatus performs the speed adjustment at the time of installation of an elevator door. Since motions near the fully opened and fully closed positions are not modified, it is also possible to set the average door closing speed optimal without delaying the door closing time more than is necessary. Consequently, it becomes unnecessary to conventionally perform calculation of door weight and individual adjustment at sites for meeting the door closing energy standard. Therefore, advantages of the present invention are not only reduction of installation and adjustment time, but also securing of elevator user's convenience.

DESCRIPTION OF THE PREFERRED EMBODIMENTS

Embodiment 1

Figure 1:
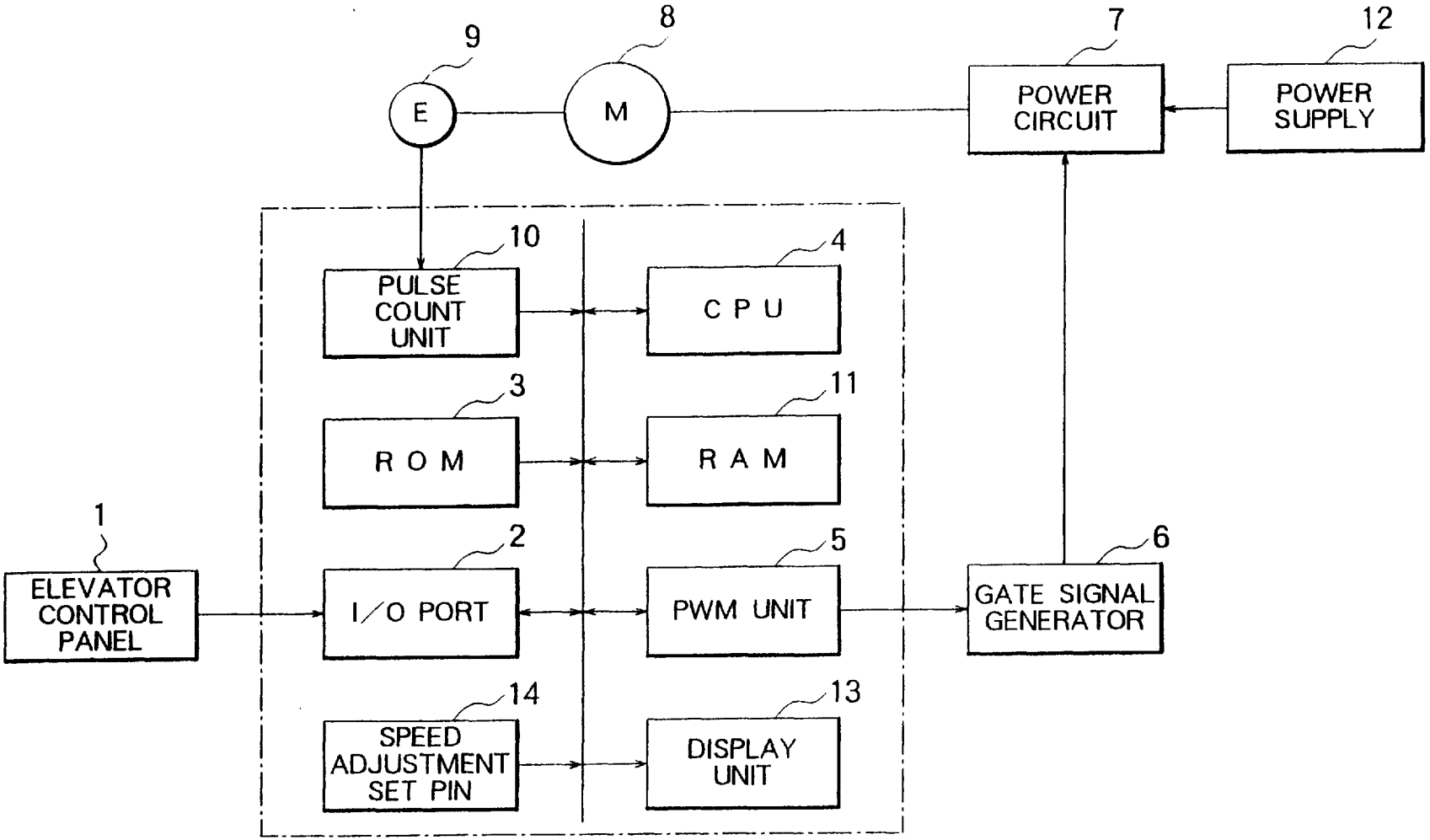
FIG. 1 is a block diagram showing the internal construction of an elevator door control apparatus according to the present invention and a known example.
Figure 2:
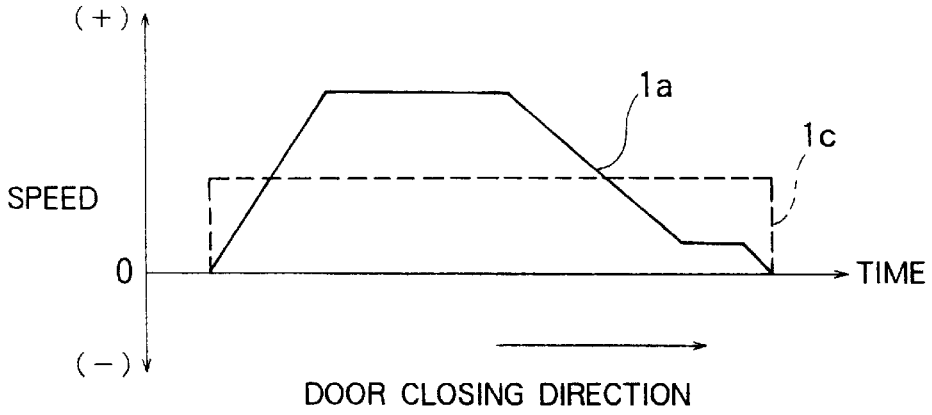
FIG. 2 is a waveform chart showing waveforms of elevator door closing motions controlled by an elevator door control apparatus according to first, second, and third embodiments of the present invention.
Figure 3:
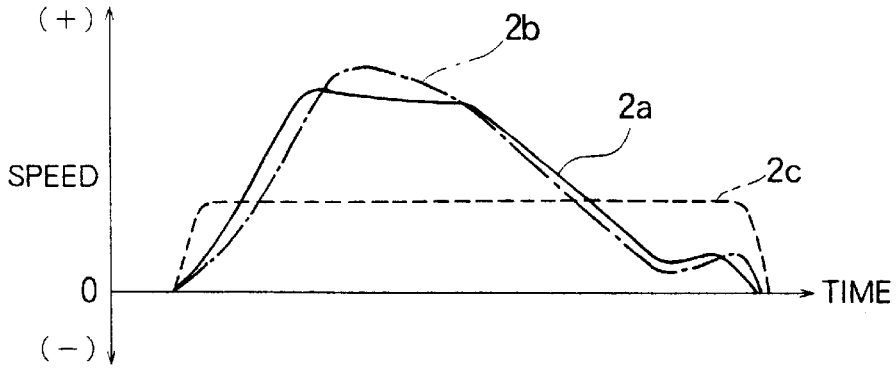
FIG. 3 is a waveform chart showing waveforms of elevator door closing motions controlled by an elevator door control apparatus according to the first, second, and third embodiments of the present invention.
Figure 4:
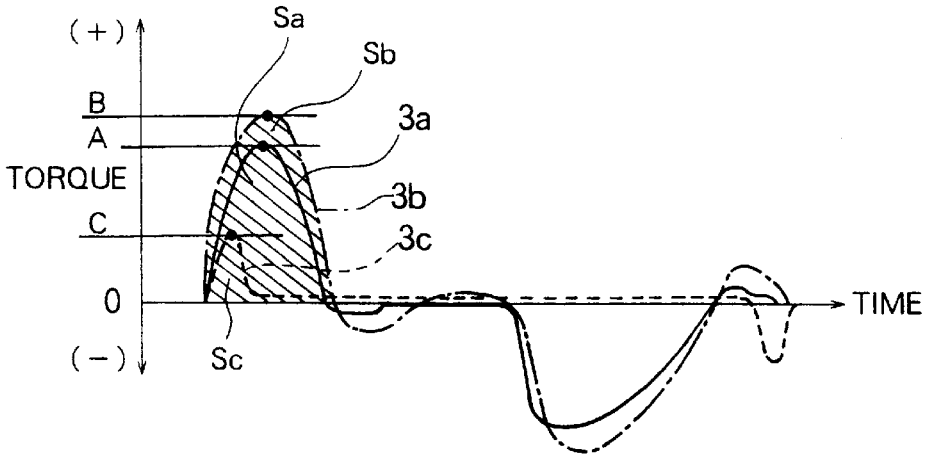
FIG. 4 is a waveform chart showing waveforms of elevator door closing motions controlled by an elevator door control apparatus according to the first, second, and third embodiments of the present invention.
Figure 7:
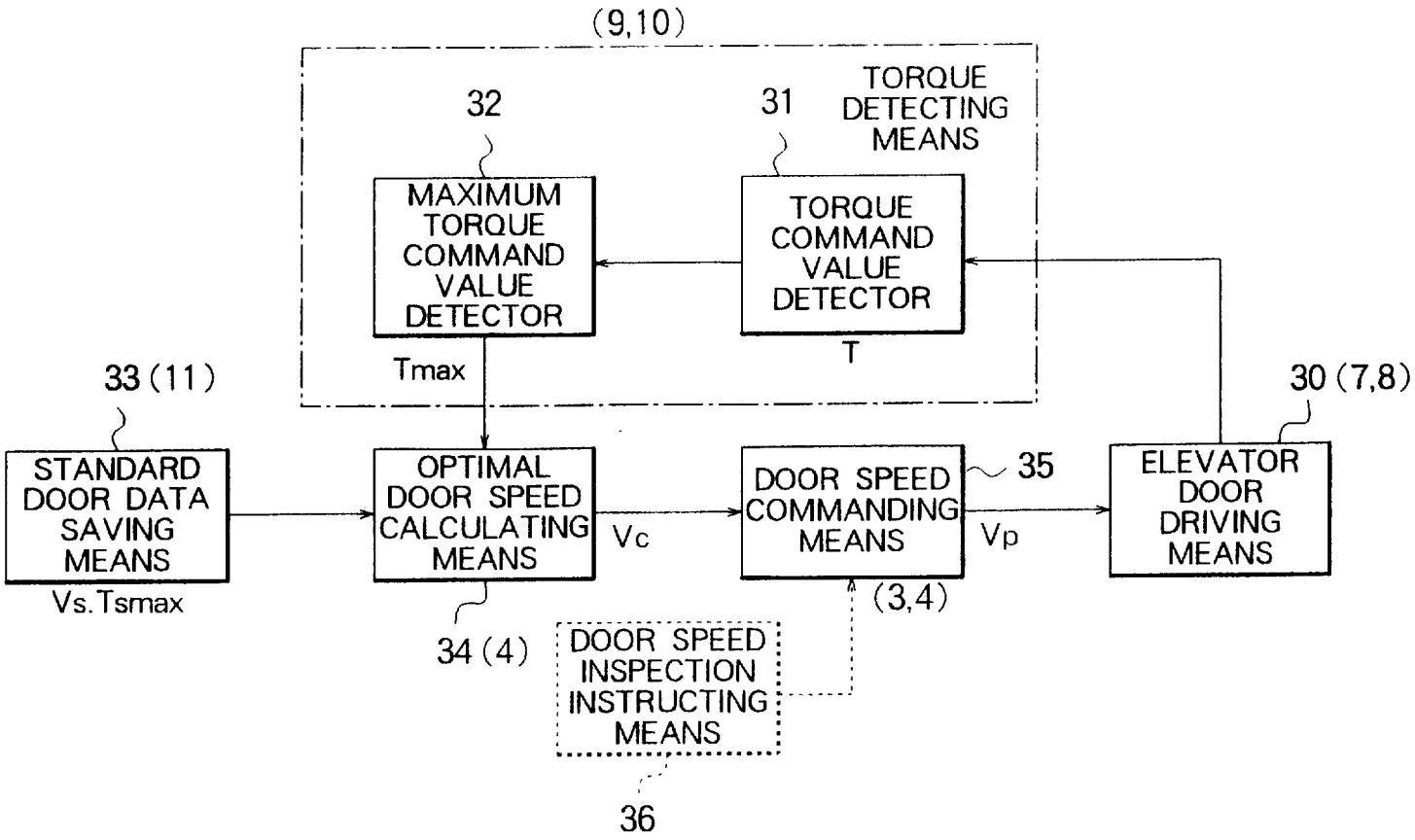
FIG. 7 is a block diagram showing the construction of an elevator door control apparatus according to the first and third embodiments.

Referring to FIGS. 2 to 4, an elevator door control apparatus according to a first embodiment of the present invention will be described. In addition, although the internal construction of the elevator door control apparatus according to the first embodiment is as shown in FIG. 7, the construction for actual design is as shown in FIG. 1. Therefore, FIG. 1 will be also be referred to. In FIG. 7, numeral 30 represents elevator door driving means for driving and controlling an elevator door based on a speed command value from door speed commanding means 35 described below, the elevator door driving means which comprises a power circuit 7 and a motor 8 in FIG. 1. Numeral 31 represents torque command value detecting means, provided in the elevator door driving means 30, for detecting torque command values T at the time of driving the door. Numeral 32 represents maximum torque command value detecting means for detecting the maximum torque command value Tmax of the driven door. Both of the two detecting means comprise a pulse encoder 9 and a pulse count unit 10 in FIG. 1. Numeral 33 represents standard door data saving means (reference data saving means) for saving a speed command value Vs and the maximum torque command value Tsmax at the standard door as data, the means comprising a RAM 11 in FIG. 1. Numeral 34 represents optimal door speed calculating means for calculating the optimal door speed Vc from the maximum torque command value Tmax and the data Vs and Tsmax saved in the standard door data saving means 33, the calculating means comprising a CPU 4 in FIG. 1. Numeral 35 represents door speed commanding means for outputting a driving speed pattern of the elevator door Vp according to the optimal door speed Vc obtained in the optimal door speed calculating means 34, the commanding means comprising a CPU 4 and a ROM 3 in FIG. 1. Construction of other elements is as shown in FIG. 1, and hence, illustration and description on them are omitted.

Next, motions will be described. The elevator door control apparatus according to the first embodiment performs door opening and closing motions at the time of installation for the time being, using a predetermined standard speed command value having a factory setting. First, as an example, a case will be described for a door closing operation performed using a standard weight door and the standard door closing command value Vs represented by waveform 1*a* in FIG. 2. Actual motor speeds from pulse counts of the pulse count unit 10 constructing the torque command value detecting means 31, they are represented by waveform 2*a* in FIG. 3, and the torque command values are represented by waveform 3*a* in FIG. 4. If the maximum torque command value Tmax is detected by the maximum torque command value detecting means 32, it is the value represented by waveform A in FIG. 4. This maximum torque command value Tmax corresponds to the standard door weight. It is possible to recognize the following relation by surveying the maximum torque command values corresponding to respective door weights:

(Door Weight when Maximum torque command value is waveform A in FIG. 4)=(Standard door weight)

Here, waveform A in FIG. 4, the maximum torque command value means that the door has the standard weight, meeting the door closing energy without adjusting door closing time, that is, average door closing speed, and hence, adjustment is not necessary in this case.

Subsequently, as another example, it is supposed that the door is heavy. It is assumed that, at the stage of installation, actual motor speeds are waveform 2*b* in FIG. 3, and torque command values are waveform 3*b* in FIG. 4 since the door weight is heavier than the standard one. If a door closing motion is performed with a predetermined standard speed command value, waveform 1*a* in FIG. 2 and the actual motor speeds and the torque command values are detected by the torque command value detecting means 31. If the maximum torque command value in this case is detected by the maximum torque command value detecting means 32, it is waveform B in FIG. 4, and hence, it is clear that this maximum torque command value corresponds to some heavy weight door. If the maximum torque command value is waveform A in FIG. 4, the door weight is standard, and, if it is assumed that the door closing energy is met, it can be determined that the door weight is heavier than the standard one, because the maximum torque command value B is larger than the value A. Therefore, it is clear that the door closing energy does not meet the standard value.

Then, in case the door closing energy does not meet the standard value as this case, in the elevator door control apparatus according to the present invention, the optimal door speed Vc is obtained based on the door weight corresponding to the maximum torque command value represented by waveform B in FIG. 4, using the following equation (1A) that is a deformation of the above-mentioned equation (1) for obtaining the door closing energy. In addition, the door closing energy can be met by modifying a speed command value using the above-mentioned equation (2) for obtaining the average door closing speed (door speed) so that door closing time may meet the above-mentioned door speed.

$$Vc=Vs\times(Tsmax/Tmax)^{1/2} \quad (1A)$$

In addition, by the speed command value for obtaining the above-mentioned optimal door speed, based on the data Vs and Tsmax in the standard door data saving means 33, the CPU 4 composing the optimal door speed calculating means 34 calculates the equations (1A) and (2). According to the result, the CPU 4 selects the optimal speed command value from speed command values in the ROM 3 and changes the speed command. Then, based on the value, the door speed commanding means 35 outputs a command signal to the elevator door driving means 30. In addition, if the processing function of the CPU 4 and memory capacity of the ROM 3 are insufficient, the method can be modified so that door weights corresponding to torque commands are displayed on the display unit 13 (FIG. 1), by a user manually modifying the speed command value to the desired optimal one using the speed adjustment set pin 14. Since other motions are similar to known examples, their explanation is omitted.

As described above, according to the present invention, door weight is recognized with torque command values, and, by modifying door closing time based on the recognition result, the average door closing speed is adjusted. Therefore, it is easy for door closing energy to meet the standard value. In addition, when the door closing time is modified, motions near the fully opened and fully closed positions are not modified. Hence, it is also possible to set the average door closing speed optimally without delaying the door closing time more than is necessary. Consequently, it becomes unnecessary to conventionally calculate door weight and individual adjustment at sites for meeting the door closing energy standard. Therefore, advantages of the present invention are not only a reduction of installation and adjustment time, but also securing of elevator user's convenience.

Embodiment 2

Referring to FIGS. 2 to 4, another embodiment of the present invention will be described. This embodiment has precision higher than that of the above-mentioned first embodiment. In door opening and closing motions, a torque command may instantaneously become large due to disturbances such as dust plugging. Owing to this, there is a possibility of erroneously recognizing door weight. Therefore, in this embodiment, information used for recognition of door weight is not the maximum torque command value simply, but the accumulated value of the torque command values. In addition, the accumulated value of power running torque can be used since a drastic change an the torque command values due to the difference of door weight occurs under acceleration in response to a speed command, that is, at power running.

Figure 8:
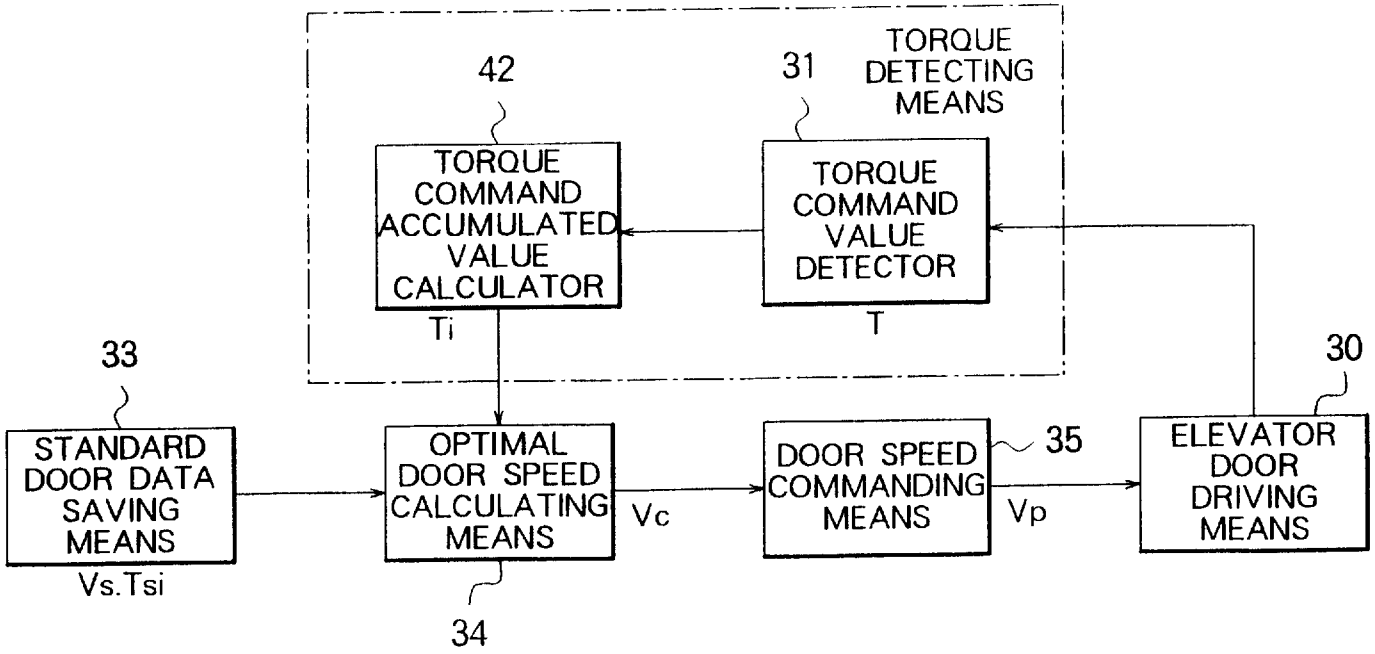
FIG. 8 is a block diagram showing the construction of an elevator door control apparatus according to the second embodiment.

FIG. 8 shows the internal construction of an elevator door control apparatus according to this embodiment. As shown in FIG. 8, this embodiment is fundamentally similar to that of the first embodiment. However, in this embodiment, a torque command accumulated value calculating means 42 for calculating a torque command accumulated value Ti is provided instead of the maximum torque command value detecting means 32 in the first embodiment. Furthermore, the standard door data saving means 33 in this embodiment saves a speed command value for the standard door Vs and a torque command accumulated value for the standard door Tsi as data. Moreover, calculation of the following equation (1B) is performed in the optimal door speed calculating means 34.

$$Vc=Vs\times(Tsi/Ti)^{1/2} \quad (1B)$$

Next, motions will be described. In the case of the standard door weight, torque command values become waveform 3*a* in FIG. 4, and a torque command accumulated value becomes a shadowed area Sa surrounded by waveform 3*a* in FIG. 4. In addition, in the case of a heavy door weight, the torque command values become waveform 3*b* in FIG. 4, and the torque command accumulated value becomes a shadowed area Sb surrounded by waveform 3*b* in FIG. 4. Similar to the first embodiment, recognition of door weight becomes possible by surveying respective door weights to torque command accumulated values beforehand. Further, based on the result, the optimal door speed is obtained, and the speed command value is modified.

As mentioned above, according to this embodiment, advantages similar to the first embodiment can be obtained. In addition, since the door weight is determined by the accumulation of torque commands, it becomes possible to avoid erroneous recognition of the door weight due to instantaneous change of a torque command which is derived from dust plugging and the like. Therefore, it becomes possible to obtain the door weight with stable precision.

Embodiment 3

Referring to FIGS. 2 to 4, a third embodiment will be described. In the above-mentioned first and second embodiments, as examples of the standard speed commands in usual door closing, cases were described in which the adjustment of average door closing speeds was performed after the door closing motion by the speed commands shown as waveform 1*a* in FIG. 2. However, since among standard speed commands there are faster ones and slower ones, various speed command values are present. Therefore, it is necessary to recognize the relations between torque command values and respective door weights regarding various speed command values, and hence, much time is needed to survey them beforehand, and it may be sometimes difficult to easily cope with them.

Then, in this embodiment, a speed command for recognizing the door weight is different from that for usual door opening and closing. The internal construction of this embodiment has a door speed inspection instructing means 36, shown in a dotted box in FIG. 7, for outputting a door speed inspection instruction signal for recognizing elevator door weight and obtaining the optimal door speed, in addition to the construction of the first embodiment shown in FIG. 7. Other components are similar to those in the first embodiment, and hence, their description is omitted. However, in this embodiment, the door speed commanding means 35 receives the door speed inspection instruction signal from the door speed inspection instructing means 36, and, according to the signal, the door is operated with a second speed command smaller than a first speed command that is the usual door speed command. Then, the optimal door speed Vc is obtained using the same operations as in the first embodiment. In addition, in this embodiment, the standard door data saving means 33 saves as the maximum torque command value, Tsmax the maximum torque command value having been obtained when the standard door was driven with the second speed command.

Motions will be described. As an example, it is assumed that the second speed command value for recognizing the door weight is the speed command value that is shown as waveform 1*c* in FIG. 2, is smaller than the usual door speed command which is the first speed command, and has a constant speed. In case a door closing motion is performed upon setting a speed command value to be waveform 1*c* in FIG. 2, an actual motor speed becomes waveform 2*c* in FIG. 3, and torque command values become waveform 3*c* in FIG. 4. The maximum torque command value in this case is shown as waveform C in FIG. 4, and a torque command accumulated value becomes a shadowed area Sc surrounded by waveform 3*c* in FIG. 4. In addition, by performing subsequent motions similar to those in either of the first or second embodiments, the optimal door speed is obtained, whereby the speed command being modified. Furthermore, it relations between torque command values and respective door weights when the speed command is waveform 1*c* in FIG. 2 should be surveyed.

As mentioned above, according to this embodiment, advantages similar to the first and second embodiments can be obtained. In addition, by using a speed command value different from that in the usual door opening and closing when the door weight is recognized, it is sufficient to consider the case of a single speed command value without surveying relations between torque command values and respective door weights for various speed command values. Therefore, the present invention can be applied to any speed command values in usual opening and closing.

Embodiment 4

Figure 5:
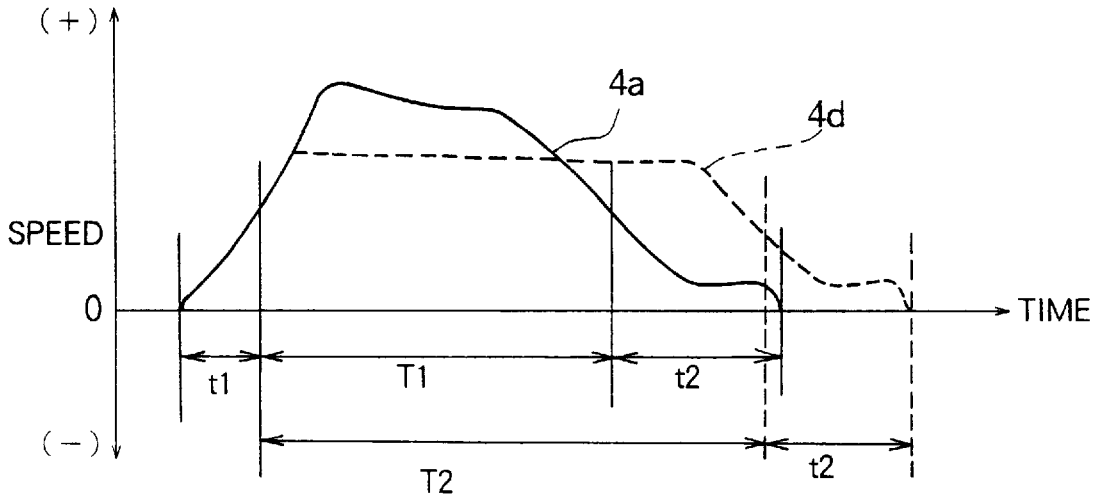
FIG. 5 is a waveform chart showing waveforms of elevator door closing motions controlled by an elevator door control apparatus according to a fourth embodiment of the present invention.
Figure 6:
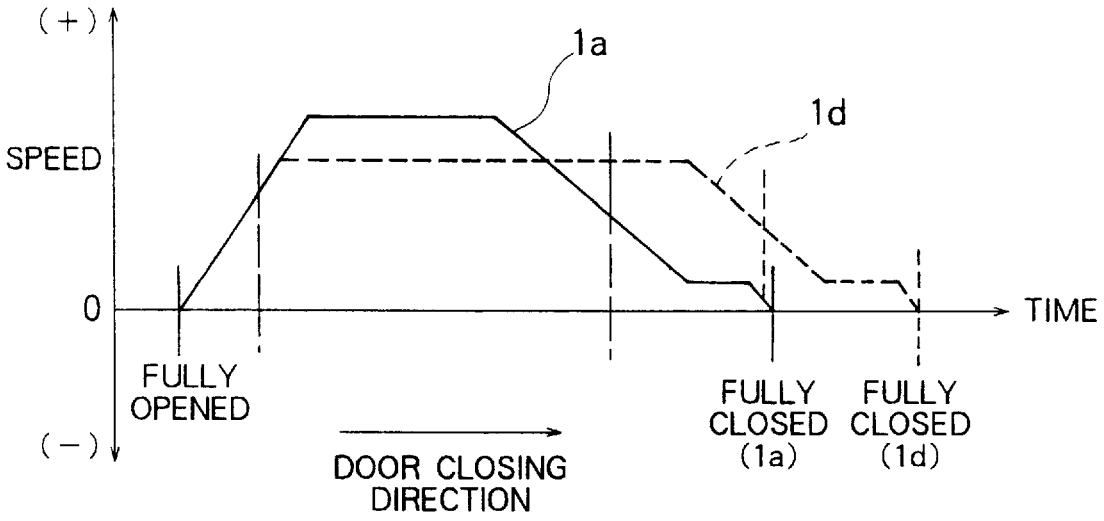
FIG. 6 is a waveform chart showing waveforms of elevator door closing motions controlled by an elevator door control apparatus according to the fourth embodiment of the present invention.

Referring to FIGS. 5 and 6, a fourth embodiment will be described. In the above-mentioned first, second, and third embodiments, it was described to obtain the door weight, to obtain the optimal door speed for meeting the standard door closing energy, and to output the speed command based on the optimal door speed. In addition, it was described that, regarding a modification of the speed command value, the door speed relating to the door closing energy was the average door closing speed and was expressed in equation (2), in the above-mentioned description of known art. Furthermore, it is necessary to remove run time near the fully opened and fully closed positions since there is the above-mentioned definition on the run time.

Generally, when the speed command is modified, a total speed including the fully opened and fully closed motions is adjusted. However, as mentioned above, it is meaningless to make the speed slow in the vicinity of the fully opened and fully closed positions as the door closing time relating to the door closing energy, that is, the door closing time. That is, if the total running time is delayed by decreasing the total speed, consequently, the running time meets the door closing energy. However, the door closing time becomes longer than is necessary, and hence, the operation efficiency of the entire elevator becomes worse.

Therefore, when the speed command is modified, the speed commands relating to partitions t1 and t2 in FIG. 5 are kept as is, and other speed command values are modified. As an example, the current speed command is set as waveform 1*a* in FIG. 6, and, if its running time is slow, the speed command value is modified so that it may become the waveform shown as waveform 1*d* in FIG. 6.

Figure 9:
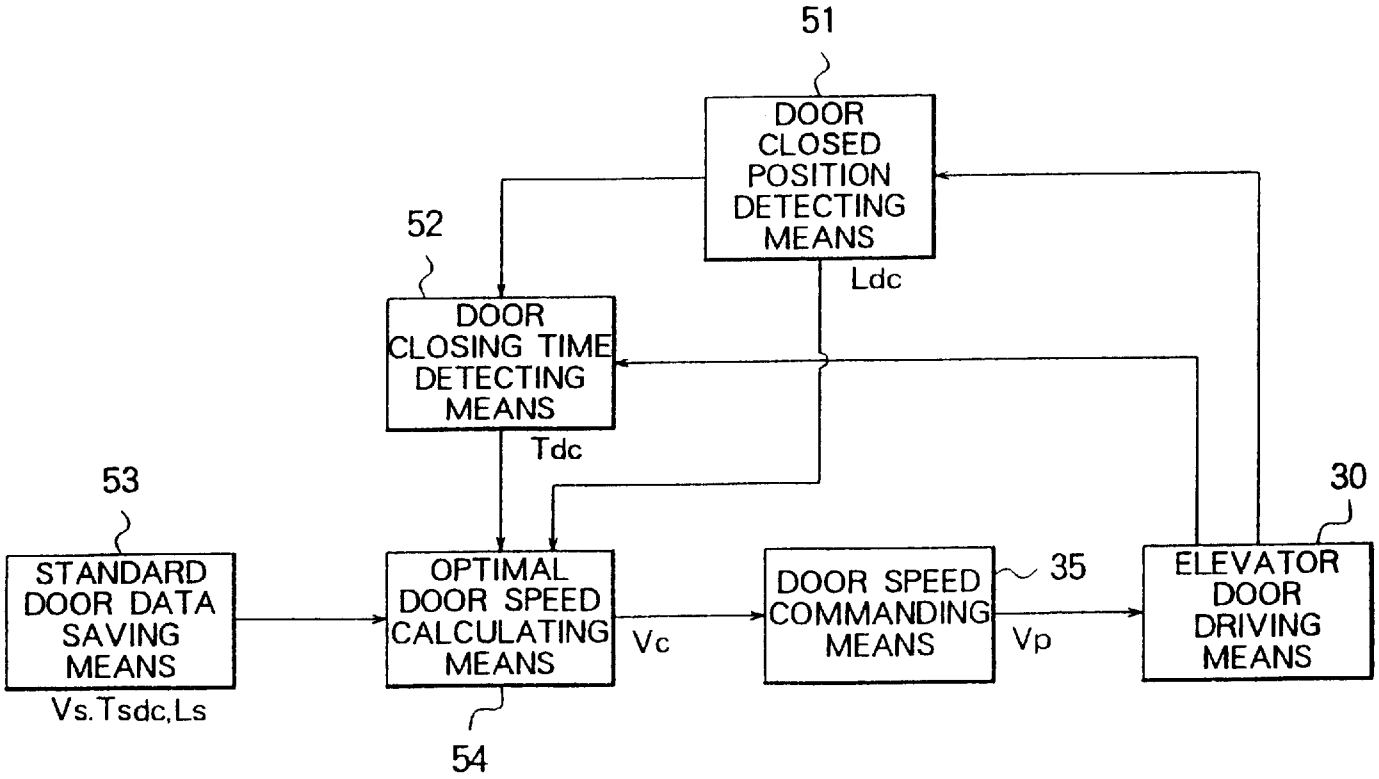
FIG. 9 is a block diagram showing the construction of an elevator door control apparatus according to the fourth embodiment.

FIG. 9 shows the construction of an elevator door control apparatus according to this embodiment. In FIG. 9, numeral 51 represents door closing position detecting means (or moving distance detecting means) for measuring a first predetermined position (the position being 25 mm distant from the fully opened position toward the closing position), a second predetermined position (the position being 25 mm distant from the fully closed position toward the opening position) , and a moving distance between both positions Ldc, based on a position signal indicating the position of an elevator door from the elevator door driving means 30. Numeral 52 represents door closing time detecting means (or time detecting means) for measuring the time required for door closing between the first and second predetermined positions. Numeral 53 represents standard door data saving means (or reference data saving means) for saving a speed command value for the standard door Vs, door closing time of the standard door between the first predetermined position and second predetermined position Tsdc, and distance between both positions Ls. In addition, numeral 54 represents optimal door speed calculating means for calculating the optimal door speed Vc using the following equation (2A), being a deformation of above-mentioned equation (2), with the door closing time measured by the door closing time detecting means 52 and the door closing time of the standard door Tsdc saved in the standard door data saving means 53.

$$Vc=Vs\times(Tdc/Tsdc)\times(Ls/Ldc) \quad (2A)$$

Consequently, since motions in the vicinity of the fully opened and fully closed positions are not modified, as mentioned above, the door closing time is not delayed more than is necessary. Therefore, it is easily possible to obtain the optimal average door closing speed, and it is possible to modify the speed command to the optimal one meeting the door closing energy.

What is claimed is:

1. An elevator door control apparatus comprising:

driving means for driving an elevator door;

torque detecting means, connected to said driving means, for detecting torque command values during driving of the elevator door;

reference data saving means for saving reference data;

optimal door speed calculating means for calculating an optimal door speed from the reference data saved in said reference data saving means and the torque command values detected by said torque detecting means; and door speed commanding means for outputting a speed command signal to said driving means, based on the door speed calculated by said optimal door speed calculating means, whereby the elevator door control apparatus performs speed adjustment at installation of the elevator door.

2. The elevator door apparatus according to claim 1 wherein said torque detecting means comprises:

a torque command value detector for detecting torque command values during driving of the elevator door; and a maximum torque command value detector for detecting a maximum value among the torque command values, said optimal door speed calculating means calculating an optimal door speed based on the reference data and the maximum value among the torque command values.

3. The elevator door apparatus according to claim 1 wherein said torque detecting means comprises:

a torque command value detector for detecting torque command values during driving of the elevator door; and a torque command accumulated value calculator for calculating a torque command accumulated value from the torque command values, said optimal door speed calculating means calculating an optimal door speed based on the reference data and the torque command accumulated values.

4. The elevator door control apparatus according to claim 1 wherein, when speed adjustment of an elevator door is performed at installation of the elevator door, in order that said door speed commanding means may output to said driving means a speed command signal different from that in a usual motion, the elevator door control apparatus further comprises door speed inspection instructing means for outputting a door speed inspection instruction signal to said door speed commanding means.

5. The elevator door control apparatus according to claim 1 wherein said reference data saving means saves data regarding speed and torque when a standard weight elevator door is driven.

6. The elevator door apparatus according to claim 5 wherein said torque detecting means comprises:

a torque command value detector for detecting torque command values during driving of the elevator door; and a maximum torque command value detector for detecting the maximum value among the torque command values, said optimal door speed calculating means calculating an optimal door speed based on the reference data and the maximum value among the torque command values.

7. The elevator door apparatus according to claim 5 wherein said torque detecting means comprises:

a torque command value detector for detecting torque command values during driving of the elevator door; and a torque command accumulated value calculator for calculating a torque command accumulated value from the torque command values, said optimal door speed calculating means calculating an optimal door speed based on the reference data and the torque command accumulated values.

8. The elevator door control apparatus according to claim 5 wherein, when speed adjustment of an elevator door is performed at installation of the elevator door, in order that said door speed commanding means may output to said driving means a speed command signal different from that in a usual motion, the elevator door control apparatus further comprises door speed inspection instructing means for outputting a door speed inspection instruction signal to said door speed commanding means.

9. An elevator door control apparatus comprising:

driving means for driving an elevator door and producing a position signal indicating elevator door position;

door moving distance detecting means for measuring moving distance of the elevator door from a first position near a fully open position to a second position near a fully closed position based on the position signal;

time detecting means for measuring time required for movement of the elevator door from the first position to the second position;

reference data saving means for saving reference data;

optimal door speed calculating means for calculating an optimal door speed from the reference data saved in said reference data saving means, the moving distance, and the time required for opening and closing; and door speed commanding means for outputting a speed command signal to said driving means, based on the door speed calculated by said optimal door speed calculating means, whereby the elevator door control apparatus performs speed adjustment at installation of the elevator door.

10. An elevator door control apparatus comprising:

driving means for driving an elevator door;

door closed position detecting means for measuring a moving distance of a door upon opening and closing;

time detecting means for measuring time required for opening and closing;

reference data saving means for saving reference data;

optimal door speed calculating means for calculating an optimal door speed from the reference data saved in said reference data saving means, the moving distance, and the time required for opening and closing, the optimal door speed, Vc, for a door of interest being calculated as $$Vc=Vs\ (Tdc/Tsdc)(Ls/Ldc)$$

where

Vs is a speed command for a standard door, stored in said reference data saving means, Tdc is door closing time between predetermined positions respectively proximate fully open and fully closed positions of the door of interest, Tsdc is door closing time between the predetermined positions for the standard door, stored in said reference data saving means, Ls is distance between the predetermined positions of the standard door, stored in said reference data saving means, and Ldc is distance between the predetermined positions of the door of interest; and door speed commanding means for outputting a speed command signal to said driving means, based on the door speed calculated by said optimal door speed calculating means, whereby the elevator door control apparatus performs speed adjustment at installation of the elevator door.

* * * * *